US006360893B1

(12) United States Patent
Lowe

(10) Patent No.: US 6,360,893 B1
(45) Date of Patent: Mar. 26, 2002

(54) CARTON SLEEVE WITH INTERLOCK

(75) Inventor: Jerry B. Lowe, San Clemente, CA (US)

(73) Assignee: Mitsubishi Digital Electronics America Inc., Irvine, CA (US)

( * ) Notice: Subject to any disclaimer, the term of this patent is extended or adjusted under 35 U.S.C. 154(b) by 0 days.

(21) Appl. No.: 09/648,432

(22) Filed: Aug. 25, 2000

(51) Int. Cl.[7] ..... B65D 19/20

(52) U.S. Cl. ..... 206/597; 206/320; 206/600

(58) Field of Search ..... 206/320, 386, 206/596–599, 600; 108/51.3, 56.1, 57.31, 57.33

(56) References Cited

U.S. PATENT DOCUMENTS

| | | | | |
|---|---|---|---|---|
| 3,608,813 A | * | 9/1971 | Blasdell | 206/599 |
| 3,752,301 A | | 8/1973 | Bluemel | |
| 4,119,205 A | * | 10/1978 | Delany | 206/600 |
| 4,291,828 A | | 9/1981 | Nigro | |
| 4,735,314 A | | 4/1988 | Kadleck et al. | |
| 4,763,832 A | | 8/1988 | Forbes, Jr. | |
| 4,765,252 A | | 8/1988 | Shuert | |
| 4,883,221 A | | 11/1989 | Brundage | |
| 4,936,451 A | | 6/1990 | Shuert | |
| 4,976,353 A | * | 12/1990 | Halliday | 206/386 |
| 5,123,541 A | * | 6/1992 | Giannini et al. | 206/600 |
| 5,145,067 A | | 9/1992 | Carver | |
| 5,188,284 A | | 2/1993 | Eisman | |
| 5,226,544 A | | 7/1993 | Gallucci et al. | |
| 5,441,154 A | * | 8/1995 | Youell, III | 206/599 |
| 5,566,722 A | | 10/1996 | Bartholomew | |

FOREIGN PATENT DOCUMENTS

| | | | | |
|---|---|---|---|---|
| EP | 202363 A | * | 11/1986 | 206/386 |
| FR | 2548139 A | * | 1/1985 | 206/386 |
| GB | 2114541 A | * | 8/1983 | 206/386 |
| GB | 2138391 A | * | 10/1984 | 206/386 |
| GB | 2221448 A | * | 7/1990 | 206/386 |

* cited by examiner

*Primary Examiner*—Luan K. Bui
(74) *Attorney, Agent, or Firm*—Lyon & Lyon LLP

(57) ABSTRACT

The present invention is directed to a load bearing shipping carton with a sleeve interlock that facilitates ease of assembly and structural integrity of the shipping carton assembly. The carton assembly includes a tray into which a product to be packaged is set, a cover which fits on top of the product, and a sleeve which slides over the top of the cover, product and tray assembly. The tray includes a forklift port sized to receive the tines of a forklift. The sleeve preferably includes a pair of flaps that fold into the forklift port and side walls that extend to or nearly to the bottom of the tray. In a preferred embodiment, the flaps are sized to a dimension that matches the forklift port and, when folded into position in the forklift port, the flaps increases the structural integrity of the forklift port. The top of the flaps is scored allowing the flap to be automatically folded into the forklift port when the carton assembly is banded together, thereby helping the sleeve to be fitted to the underlying packaging assembly.

19 Claims, 4 Drawing Sheets

CARTON SLEEVE WITH INTERLOCK

FIELD OF THE INVENTION

The present invention relates generally to shipping cartons, and more particularly, to a load bearing carton sleeve with an interlock that facilitates ease of assembly and structural integrity of the shipping carton in final shipping form.

BACKGROUND OF THE INVENTION

PTVs or "big screen" TVs are a popular alternative to picture tube TVs because they provide comparably larger viewable screens that cannot be efficiently produced using conventional picture tubes. The size of the screens typically range from about 45 to about 73 inches along their diagonal, while the enclosures typically range from about 48 inches to over 65 inches in height, from about 38 inches to over 65 inches in width, and from about 22 inches to over 29 inches in depth. The typical weight of big screen TVs ranges from about 165 pounds for the smallest PTVs to over 440 pounds for some of the largest PTVs.

Conventional packaging for PTVs and other products of similar size and weight, includes a tray into which the product is set, a cover which fits on top of the product, and a sleeve which slides over the top of the cover, product and tray assembly. The sleeve, cover and tray are typically formed from corrugated cardboard. Once in place, a pair of packaging bands extend about the sleeve and tray to hold the carton assembly together. Because of the size and weight of the PTVs, the tray usually includes a port to allow the assembled package to be moved and stored using a forklift or some other lifting apparatus. To allow passage of forklift tines into the forklift port, the sleeve is positioned above the port. In this arrangement, the corrugate sleeve does not carry any vertical loads resulting when the packages are stacked atop of one another in warehouses. The sleeve merely acts as a dust and scuff shield. The PTVs, or other packaged products, end up carrying all of the vertical loads applied to the packages, which typically occurs when the loaded cartons are stacked in warehouses and, as a result, run the risk of being damage.

Other disadvantages of this package assembly include an overall lack of structural integrity and lack of ease of assembly due to the sleeve not being firmly attached to the product, tray and cover assembly.

Thus, it would be desirable to provide a shipping carton for PTVs, and other products of similar size and weight, that is capable of carrying a vertical load and that facilitates overall structural integrity and ease of assembly of the package.

SUMMARY OF THE INVENTION

The present invention is directed to a load bearing shipping carton with a sleeve interlock that facilitates ease of assembly and structural integrity of the shipping carton assembly. The carton assembly includes a tray into which a product to be packaged is set, a cover which fits on top of the product, and a sleeve which slides over the top of the cover, product and tray assembly. The tray includes a forklift port sized to receive the tines of a forklift or some other lifting apparatus. In a particularly innovative aspect of the invention, the sleeve preferably includes a pair of flaps that fold into the forklift port and side walls that extend to or nearly to the bottom of the tray.

In another innovative aspect of the invention, the flaps are sized to match the forklift port and, when folded into position in the forklift port, the flaps increase the structural integrity of the forklift port and more securely attache the sleeve to the tray to increase the overall structural integrity of the carton assembly.

In yet another innovative aspect of the invention, the top of the flap is scored allowing the flap to be automatically folded into the forklift port when the carton assembly is banded together thereby helping the sleeve to be more easily fitted to the underlying packaging assembly.

Other aspects and features of the present invention will become apparent from consideration of the following description taken in conjunction with the accompanying drawings.

DETAILED DESCRIPTION OF THE PRIOR ART

Figure 1:
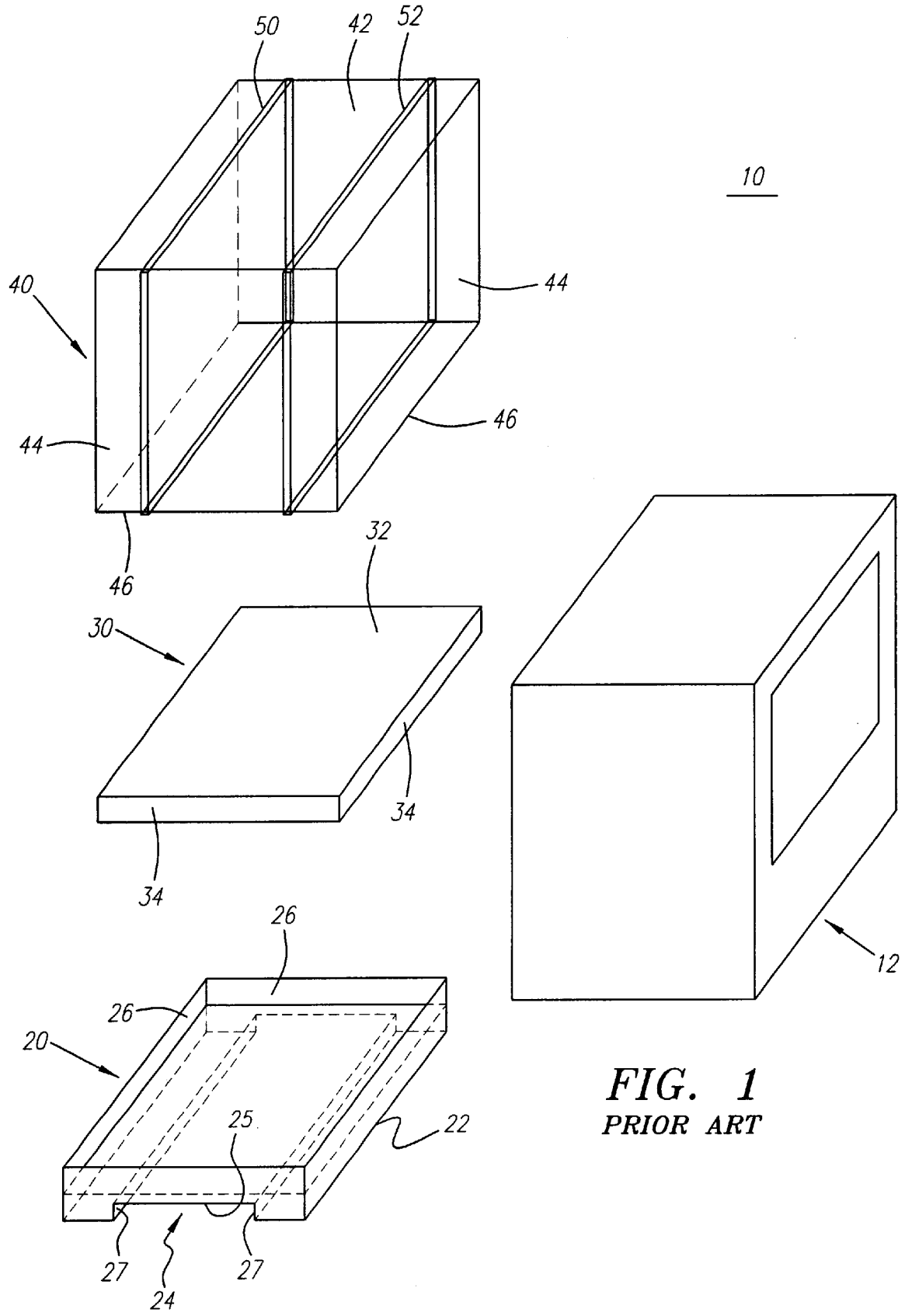
FIG. 1 PRIOR ART
FIG. 1 is an exploded isometric view of a conventional shipping carton assembly for PTVs and other products of similar size and weight.
Figure 2:
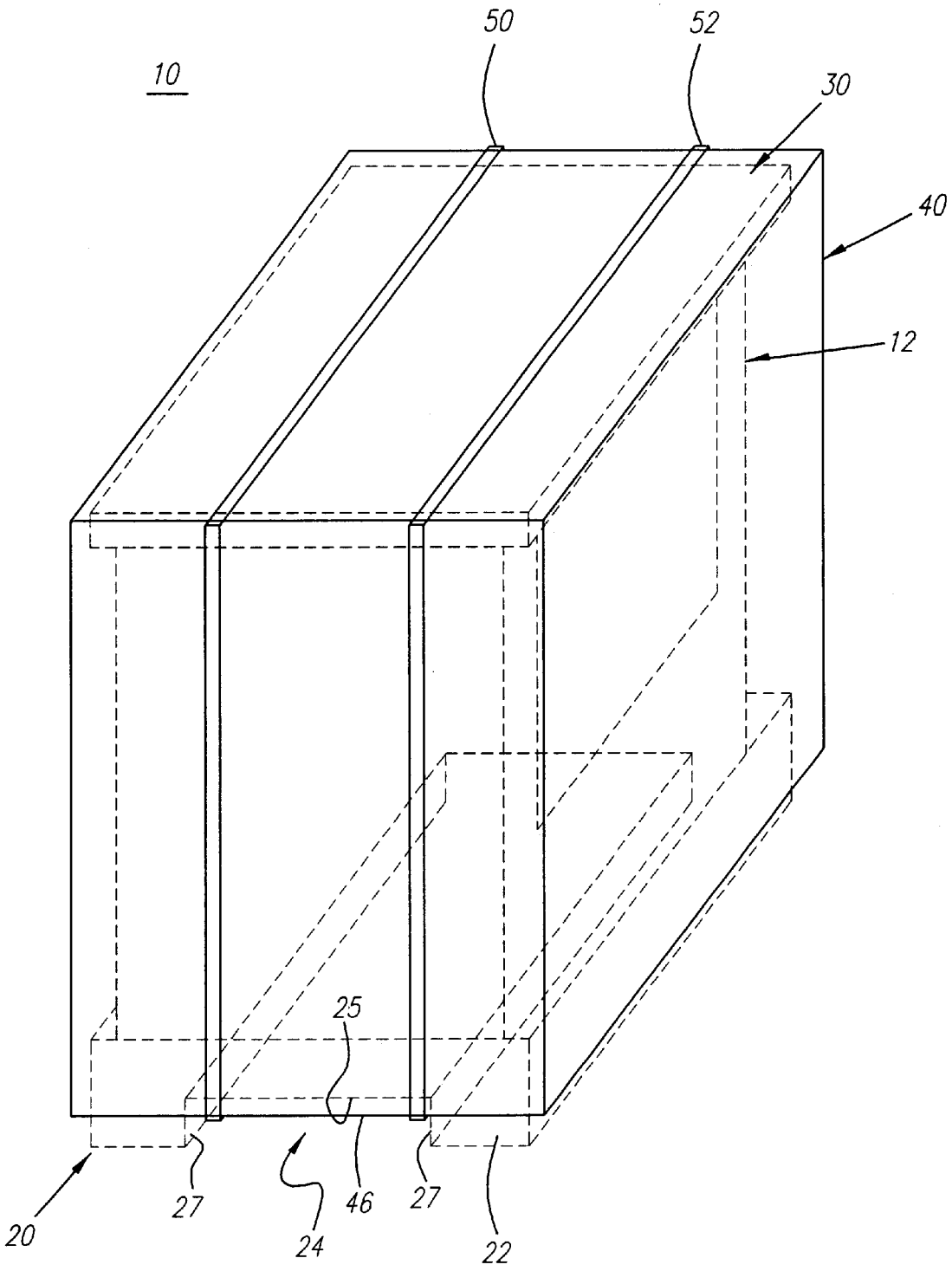
FIG. 2 PRIOR ART
FIG. 2 is an isometric view of the conventional shipping carton of FIG. 1 shown in final shipping form.

Referring to FIGS. 1 and 2, a conventional shipping carton assembly 10 used for shipping and storing PTVs and other products of similar size and weight is shown. The shipping carton 10 is shown to include a tray 20 into which a PTV 12 or some other product to be packaged is set, a cover 30 that fits on top of the PTV 12, and a sleeve 40 that slides over the top of the cover 30, PTV 12 and tray 20 assembly. The tray 20, cover 30, and sleeve 40 are each typically formed of corrugated cardboard.

The tray 20 includes a base 22 with upwardly extending sidewalls 26 forming a cavity in which the PTV 12 is set. Because of the size and weight of a typical PTV 12, the base 22 of the tray 20 usually includes a port 24 to allow the assembled package to be moved and stored using a forklift or some other lifting apparatus. The forklift port 24 includes upwardly extending side walls 27 and a top wall 25 that form a generally rectangularly shaped channel extending through the base 22 from the front of the base 22 to the rear of the base 22. The forklift port 24 is sized to allow the passage of forklift tines into the channel formed by the top and side walls 25 and 27.

The cover 30 includes a top wall 32 and downwardly extending sidewalls 34. The cover 30 is sized to fit over the top of the PTV 12 or other products with the sidewalls 34 extending down and around the upper portion of the PTV 12 or other product.

The sleeve 40 includes a top wall 42 and downwardly extending sidewalls 44 to form a generally open bottom box. When slid into position over the cover 30, PTV 12 and tray 20 assembly, the sleeve 40 is positioned above the forklift port 24 of the tray 20 to allow passage of forklift tines into the forklift port 24. Once the sleeve 40 is properly positioned the assembly is banded with a pair of metal packing strips 50 and 52.

As shown in FIG. 2, the bottom edge 46 of the sleeve 40 is positioned above the top wall 25 of the forklift port 24 such that the bottom edge 46 is spaced from the bottom of the tray 20. In this arrangement, the corrugate sleeve 40 does not carry any vertical loads resulting from stacking the fully loaded shipping cartons 10 atop of one another in warehouses. With the sleeve 40 merely acting as a dust and scuff shield, the PTVs 12 or other products loaded into the cartons 10 end up carrying all of the vertical loads applied to the loaded cartons 10 when they are stacked and, as a result, run the risk of being damaged.

DETAILED DESCRIPTION OF PREFERRED EMBODIMENTS

Figure 3:
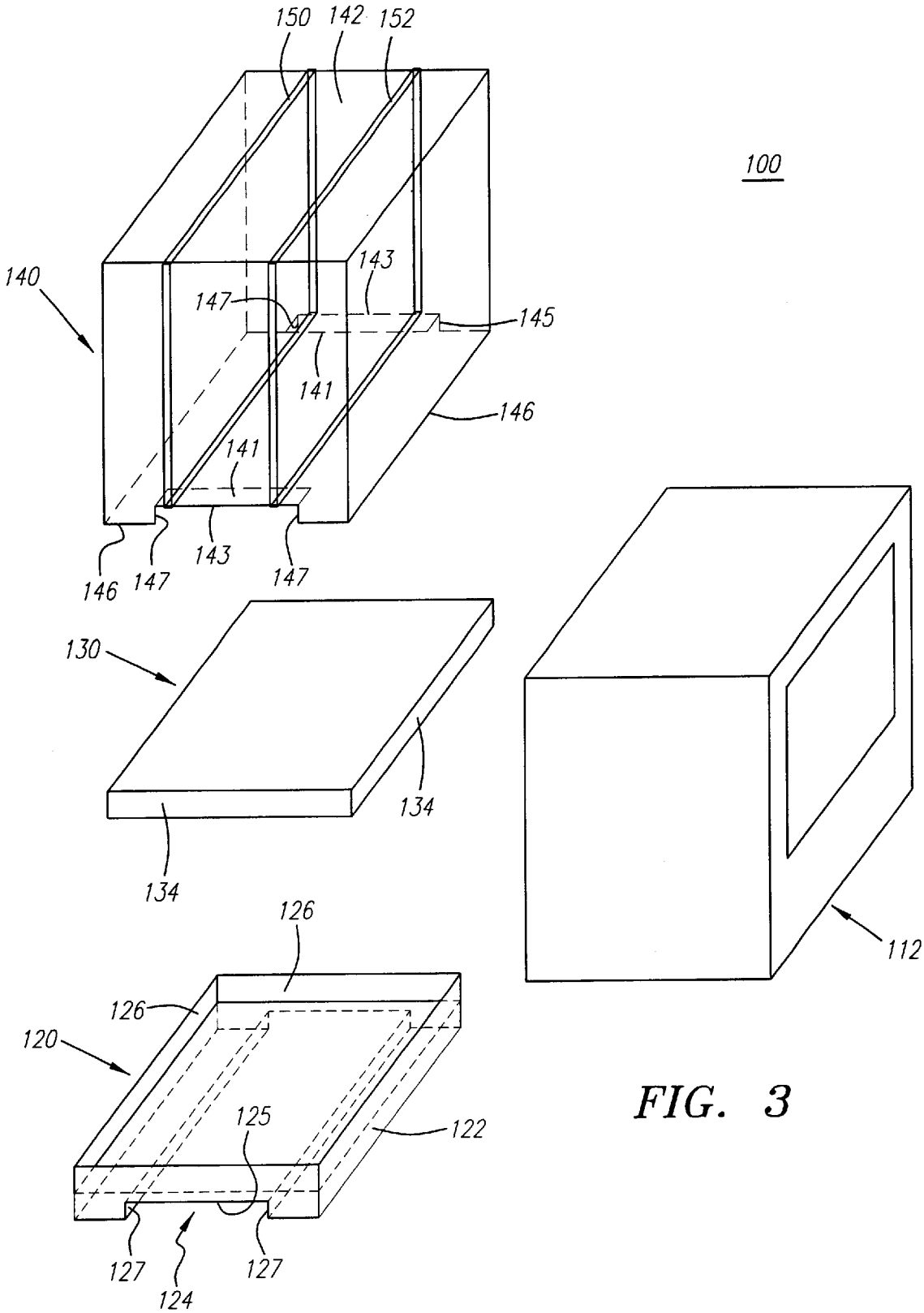
FIG. 3 is an exploded isometric view of the shipping carton assembly of the present invention used to package PTVs and other products of similar size and weight.
Figure 4:
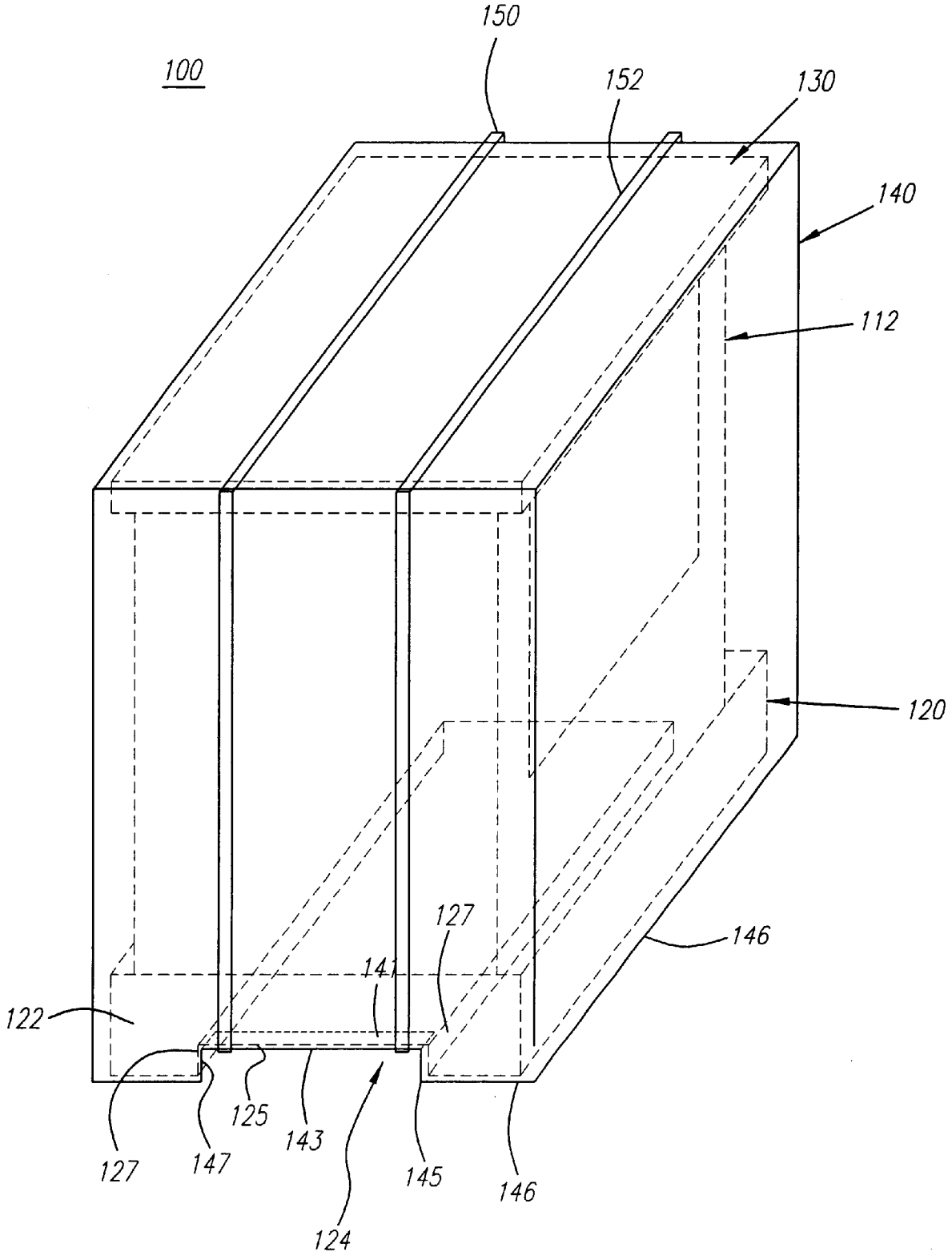
FIG. 4 is an isometric view of the shipping carton of the present invention shown in final shipping form.

Referring to FIGS. 3 and 4, a shipping carton assembly 100 of the present invention used for shipping and storing PTVs 112 and other products of similar size and weight is shown. Like the conventional shipping carton 10 described above, the shipping carton 100 of the present invention is shown to include a tray 120 into which a PTV 112 or other product is set, a cover 130 that fits on top of the PTV 112, and a sleeve 140 that slides over the top of the cover 130, PTV 112 and tray 120 assembly. The tray 120, cover 130, and sleeve 140 are each preferably formed of corrugated cardboard.

The tray 120, which is identical to the conventional tray 20 described above, includes a base 122 with upwardly extending sidewalls 126 forming a cavity in which the PTV 112 is set. The base 122 of the tray 120 preferably includes a port 124 to allow the assembled package to be moved and stored using a forklift or some other lifting apparatus. The forklift port 124 includes upwardly extending side walls 127 and a top wall 125 that form a generally rectangularly shaped channel extending through the base 122 of the tray 120 from the front of the base 122 to the rear of the base 122. The forklift port 124 is sized to allow the passage of forklift tines into the channel formed by the top and side walls 125 and 127.

The cover 130 includes a top wall 132 and downwardly extending side walls 134. The cover 130 is sized to fit over the top of the PTV 112 or other product with the sidewalls 134 extending down and around the upper portion of the PTV 112.

The sleeve 140 preferably includes a top wall 142 and downwardly extending sidewalls 144 to form a generally open bottom box. Preferably, two of the opposing sidewalls 144 include flaps 141 cut therein. The flaps 141 are formed by making two matching cuts 145 and 147 extending upwardly from the bottom edge 146 of the sleeve 140. The sidewalls 144 are preferably scored between the cuts 145 and 147 to enable the flaps 141 to be inwardly folded. Alternatively, the flaps 141 may be cut out to form a slot in the sleeve.

When the sleeve 144 is slid into position over the cover 130, PTV 112 and tray 120 assembly, the sidewalls 144 preferably extend to, or nearly to, the bottom of the tray 120 and the flaps 141 are preferably folded into the forklift port 124 of the tray 120 to allow passage of forklift tines into the forklift port 124. Once the sleeve 140 is properly positioned the assembly is banded with a pair of metal packing strips 150 and 152.

As shown in FIG. 4, the bottom edge 146 of the sleeve 140 is positioned adjacent the bottom of the tray 120. In this arrangement, the corrugate sleeve 140 advantageously carries all or a portion of any vertical load applied to the top of the carton 100 loaded with a PTV 112 or some other product. The flaps 141 are preferably cut to a dimension to match the width of the opening of the channel formed by the side and top walls 127 and 125 of the forklift port 124. With the flaps 141 folded and banded in position with packing strips 150 and 152, the flaps 141 advantageously increase the structural integrity of the forklift port 124 and more firmly position the sleeve 140 to the packaging assembly of the cover 130, PTV 112 and tray 120 to increase the overall structural integrity of the carton assembly 100. While banding the carton assembly 100, the flaps 141 advantageously tend to be automatically folded into the forklift port 124 resulting in better positioning of the sleeve 140 on the carton assembly 100. Thus, the flaps 141 of the sleeve 140 facilitate ease of assembly by helping the sleeve 140 fit to the underlying packaging assembly and advantageously stiffen the forklift port 124.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A shipping carton comprising a device tray including a base, upwardly extending sidewalls forming a cavity, and a port formed in a side of the base below a top of the base and adapted to receive at least a portion of a lifting apparatus, a sleeve having side walls and at least one open end, the side walls of the sleeve being slidably received over the tray and extending adjacent to the bottom of the tray beyond an uppermost portion of the port, and an interlocking member coupled to the sleeve and being receivable in the port.

2. The shipping carton of claim 1 further comprising a device cover slidably receivable within the sleeve, the cover including a top and side walls forming a cavity.

3. The shipping carton of claim 1 wherein the interlocking member comprises a flap integrally formed within one of the side walls of the sleeve.

4. The shipping carton of claim 3 wherein the flap is formed by two generally vertical cuts in the one of the side walls extending from a bottom edge of the one of the side walls at the at least one open end of the sleeve.

5. The shipping carton of claim 4 wherein the flap is foldable into the port in the base of the tray.

6. The shipping carton of claim 5 wherein the flap is scored between top ends of the cuts.

7. The shipping carton of claim 6 further comprising a packing strip extending about the exterior of the sleeve and tray to band the sleeve and tray together.

8. The shipping carton of claim 7 wherein the flap is held folded into the port by the packing strip when the sleeve and tray are banded together.

9. The shipping carton of claim 8 wherein the flap is sized to a dimension substantially equal to the opening of the port.

10. The shipping carton of claim 9 wherein the interlocking member includes a second flap formed in another one of the sidewalls of the sleeve.

11. The shipping carton of claim 10 wherein the port in the base of the tray comprises a channel formed in the base and extending between opposing sides of the base.

12. A load bearing shipping carton assembly comprising a device tray including a base, upwardly extending sidewalls forming a cavity, and an open ended channel formed in the base below a top of the base and extending between opposing sides of the base, and adapted to receive at least a portion of a lifting apparatus, a device cover including a top and side walls forming a cavity, a sleeve having side walls and at least one open end, the side walls of the sleeve being slidably received over the tray and cover, and extending to the bottom of the tray beyond an uppermost portion of the channel, and interlocking members coupled to the sleeve and being receivable in the channel.

13. The shipping carton of claim 12 wherein the interlocking members comprise first and second flaps integrally formed in opposing side walls of the sleeve.

14. The shipping carton of claim 13 wherein the first and second flaps are each formed by two generally vertical cuts extending from a bottom edge of the opposing side wall at the at least one open end of the sleeve.

15. The shipping carton of claim 14 wherein the first and second flaps are foldable into the channel of the tray.

16. The shipping carton of claim 15 wherein the first and second flaps are scored between the tops of the cuts.

17. The shipping carton of claim 16 further comprising a packing strip extending about the exterior of the sleeve and tray to band the sleeve and tray together.

18. The shipping carton of claim 17 wherein the first and second flaps are held folded into the channel when the sleeve and tray are banded together.

19. The shipping carton of claim 16 wherein the first and second flaps are sized to a dimension substantially equal to the dimension of an opening of the channel.

* * * * *